US006116120A

United States Patent [19]

Boe

[11] Patent Number: 6,116,120

[45] **Date of Patent: *Sep. 12, 2000**

[54] ADJUSTABLE TOOL FOR APPLYING TORQUE TO A CPU FAN UNIT

[75] Inventor: Craig L. Boe, Nampa, Id.

[73] Assignee: Micron Electronics, Inc., Nampa, Id.

[ * ] Notice: This patent issued on a continued prosecution application filed under 37 CFR 1.53(d), and is subject to the twenty year patent term provisions of 35 U.S.C. 154(a)(2).

[21] Appl. No.: 08/925,913

[22] Filed: Sep. 9, 1997

[51] Int. Cl.[7] ..... B25B 13/16

[52] U.S. Cl. ..... 81/163; 81/176.3; 81/461; 361/695

[58] Field of Search ..... 81/461, 176.3, 81/163; 361/687, 688, 695

[56] References Cited

U.S. PATENT DOCUMENTS

| | | | |
|---|---|---|---|
| D. 238,660 | 2/1976 | Russell . | |
| 519,582 | 5/1894 | Lerch | 81/461 |
| 673,056 | 4/1901 | Jacobs | 81/461 X |
| 897,857 | 9/1908 | Spaulding . | |
| 1,063,717 | 6/1913 | Metcalf | 81/176.3 X |
| 2,417,926 | 3/1947 | Ghiglieri . | |
| 2,435,346 | 2/1948 | Ghiglieri . | |
| 2,801,562 | 8/1957 | Stricklett et al. | 81/163 |
| 3,094,022 | 6/1963 | Young . | |
| 3,253,486 | 5/1966 | Beck | 81/163 |
| 3,654,825 | 4/1972 | Moddemeijer et al. . | |
| 3,662,628 | 5/1972 | Schnepel . | |
| 4,296,616 | 10/1981 | Guiler . | |
| 4,305,315 | 12/1981 | Neppel . | |
| 4,336,729 | 6/1982 | Eppenbach | 81/176.3 X |
| 5,123,310 | 6/1992 | McManus . | |
| 5,523,918 | 6/1996 | Chiou . | |

*Primary Examiner*—D. S. Meislin

*Attorney, Agent, or Firm*—Knobbe, Martens, Olson & Bear, LLP

[57] ABSTRACT

Disclosed is a tool for applying torque to a CPU fan unit and mounting the fan unit onto a mounting structure. The tool includes a pair of mounting pins for engaging the CPU fan unit. The position of the mounting pins is adjustable so that the tool may be used to apply torque to fan units of various sizes. The pins on the tool are configured to be inserted into mounting notches on the outer housing of the fan unit so that torque may be transferred from the tool to the fan unit.

10 Claims, 2 Drawing Sheets

ADJUSTABLE TOOL FOR APPLYING TORQUE TO A CPU FAN UNIT

BACKGROUND OF THE INVENTION

1. Field of the Invention

The invention relates to a torque tool for a CPU fan unit. More particularly, the invention relates to a tool for applying desired degrees of torque to a CPU fan unit, where the tool is adjustable so that it may be used with CPU fan units of various styles and sizes.

2. Description of Related Art

Many of the central processing units (CPUs) that are currently used with computers operate at high temperatures and thus generate a great amount of heat during use. In order to reduce the temperatures, CPU fan units are used to provide air flow to the CPU to dissipate the heat and reduce the likelihood of the CPU overheating. The fan unit is often mounted within the computer casing directly adjacent the CPU. The fan units are generally small in size to reduce the consumption of space. Moreover, the fan units are generally manufactured of a lightweight material to reduce the overall weight of the computer. As a result, the fan units are fragile and are easily broken if an assembler applies a relatively small threshold force to the fan unit.

The CPU fan unit is typically mounted within the computer casing by screwing an outer housing of the fan unit onto a mounting structure, such as a small clip or bracket. Like the CPU fan unit, the mounting structure is typically small and lightweight, making it easily susceptible to breaking. Currently, assemblers screw the fan unit onto the mounting structure by hand. The assembler typically grasps the outer housing of the fan unit and tightens it onto the mounting structure until the assembler feels resistance to further tightening. The amount of tightening the assembler applies to the fan unit is thus determined by "feel." As a result, the assembler often applies too much torque to the fan unit or applies uneven torque so that the fan unit twists during tightening. This may undesirably result in over-tightening and breakage of the fan unit or the mounting structure. There is, therefore a need for a tool specially designed to tighten CPU fan units onto a mounting structure in a computer. Such a tool should be adjustable for use with fan units of various sizes and styles. The tool should also be adaptable for use with current torque driving tools, such as a ratchet wrench or torque screw driver. The tool should be capable of applying uniform and predetermined levels of torque to a fan unit in order to reduce the risk of over-tightening and breakage to the fan unit or mounting structure.

SUMMARY OF THE INVENTION

One aspect of the invention relates to a torque tool comprising a main section extending along a longitudinal axis, a head section connected to the main section. The head section defines a transverse axis oriented at an angle relative to the longitudinal axis. A pair of mounting pins extends from the head section, the mounting pins being movably positioned along the transverse axis and configured to engage a member so as to apply torque thereto. An actuation member is coupled to the mounting pins. The actuation member is configured to adjust the position of the mounting pins along the transverse axis.

Another aspect of the invention relates to a torque tool comprising a main section, a torque driver connected to the main section and configured to apply torque about a longitudinal axis, a head section coupled to the main section, a set of pins extending from the head section, the pins being movable along a common line oriented at an angle to the longitudinal axis, and an actuator coupled to the pins and the head section. The actuator is configured to move the pins in opposite directions along the common line.

In yet another aspect of the invention, there is disclosed a torque tool comprising an elongated handle, a head section connected to a first end of the elongated handle, a first pin and a second pin extending from the head section, the first pin and second pin movable in opposite directions along a common axis, and means for moving the first pin and the second pin along the common axis.

Yet another aspect of the invention relates to a torque tool comprising a main body rotatable about a longitudinal axis and a rotatable threaded shaft aligned along a transverse axis and coupled to the main body. The threaded shaft is divided into a right-hand threaded portion and a left-hand threaded portion. A knob is fixedly attached to the threaded shaft so that rotation of the knob causes the threaded shaft to rotate. A first mounting block is coupled to the right hand threaded portion of the threaded rod and a second mounting block is coupled to the left-hand threaded portion of the threaded rod. A first mounting pin is coupled to the first mounting block and a second mounting pin is coupled to the second mounting block. Rotation of the knob causes the mounting blocks to move in opposite directions along the threaded shaft.

BRIEF DESCRIPTION OF THE DRAWINGS

These and other features of the invention will now be described with reference to the drawings of one embodiment, which are intended to illustrate and not to limit the invention, and in which.

DETAILED DESCRIPTION OF THE INVENTION

Figure 1:
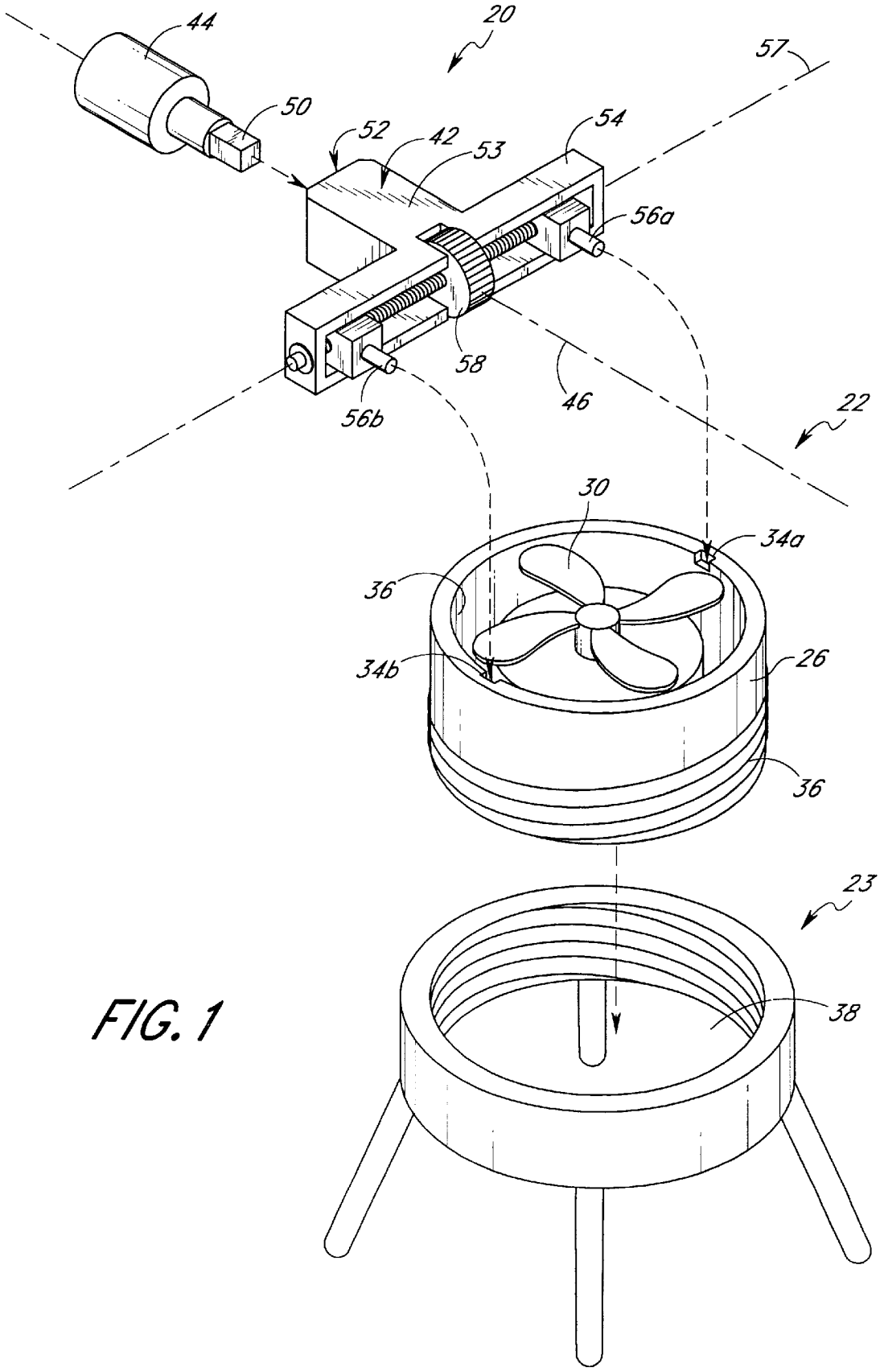
FIG. 1 is a perspective view of an embodiment of a CPU fan torque tool shown in combination with a CPU fan unit and mounting structure.

Reference will now be made to the attached drawings wherein like numerals refer to like parts throughout. FIG. 1 is a perspective view of a CPU fan torque tool 20 positioned adjacent a CPU fan assembly 22. The torque tool 20 is used to apply torque to the CPU fan assembly 22 and thereby mount and tighten the fan assembly 22 onto a mounting structure 23. As described in detail below, the torque tool is adjustable so that it may be used with CPU fan assemblies of various sizes and styles.

Referring to FIG. 1, the illustrated embodiment of the CPU fan assembly 22 generally comprises a cylindrically-shaped fan housing 26 and a fan 30 rotatably mounted therein. A circular aperture 36 extends through a front face of the CPU fan housing 26 and communicates with the fan 30. In the illustrated embodiment, a pair of diametrically-opposed mounting notches 34*a* and 34*b* are located on the interior periphery of the fan housing 26 along the perimeter of the aperture 32. Alternatively, the mounting notches 34 may be located on the outer surface of the fan housing 26. It will be appreciated that the shape of the fan housing 26 is not limited to a cylindrical shape, but could take on any of a wide variety of shapes. Additionally, the fan 30 may comprise any of a wide variety of fan types used to cool CPUs.

Referring to FIG. 1, the exterior rear of the fan housing 26 includes a threaded portion 36. The threaded portion 36 rotatably mates with a correspondingly-threaded aperture 38 in the mounting structure 23. In the illustrated embodiment, the mounting structure 23 comprises a frame-like member configured to receive the fan housing 26 through the aperture 38. It will be appreciated that the mounting structure could comprise any of a wide variety of well-known mounting structures for CPU fan units. Additionally, although in the illustrated embodiment the fan assembly 22 is a male member and the mounting structure 38 is a female member, it will be appreciated that the mounting structure 38 and fan housing 26 could mate in any combination of threaded male-female relationships.

During use, the fan 30 rotates and draws air into the fan housing 26 through the aperture 32 in a well known manner. The air flow is then exhausted through the rear of the fan housing 26 and onto the CPU for cooling. The fan assembly 22 is installed within the computer directly over the processing chip (not shown) by screwing the fan assembly 22 onto the mounting structure 38. However, those skilled in the art will appreciate that the fan assembly 22 may be mounted in any of a wide variety of locations within the computer.

Referring to FIG. 1, the torque tool 20 generally comprises an adapter portion 42 and a torque driver 44 configured to removably couple with the adapter portion 42. The adapter portion 42 and torque driver 44 together generally extend along an axis 46. When coupled, the adapter portion 42 and torque driver 44 are rotated to apply torque to the fan assembly 22 about the axis 46, as described more fully below. The torque driver 44 may comprise any of a wide variety of tools for applying torque, such as a ratchet wrench or a screw-driver type tool with a socket at its end for coupling to the adapter portion. In one embodiment, the torque driver 44 comprises a tool of the type that an installer may configure to apply only a desired threshold level of torque, as will be known to those skilled in the art. In this manner, an installer may set the set the torque driver 44 so that the torque tool 20 will not over-tighten the fan assembly onto the mounting structure 38.

As shown in FIG. 1, the adapter portion 42 and torque driver 44 mate using a standard socket-type coupling. Specifically, a male member 50 extends from one end of the torque driver 44. The male member 50 mates in a press-fit fashion to a correspondingly-shaped female member 52 located at a coupling end of the adapter portion 42. The male and female couplers 50, 52 together comprise a socket connection of the type that is commonly used to couple a ratchet wrench handle or a screwdriver handle to a socket of a socket wrench. In this manner, the adapter portion 42 may be used in combination with any of a wide variety of torque driving tools that are commonly available in assembly shops. Alternatively, the adapter portion 42 and torque driver 44 may be integrally formed into a single unit. It will be appreciated that the adapter portion 42 of the invention can be modified to be used with any of a wide variety of well-known torque tools without departing from the spirit of the present invention.

As shown in FIG. 1, the adapter portion 42 generally includes a main section 53 and elongated head section 54 that includes two pins 56*a* and 56*b* for engaging with the fan assembly 22, as described more fully below. The elongated head section 54 generally extends along an axis 57 that is oriented substantially normal to the axis 46. The pins 56*a*, 56*b* extend from the head section 54 in a direction substantially parallel to the axis 46. The pins 56*a*, 56*b* are each positioned along the axis 57 an equal distance D (FIG. 3) from the point where the axis 44 intersects the axis 57. The distance D is adjustable through use of an actuation member 58 located on a central portion of the head section 54, as described more fully below. In the illustrated embodiment, the actuation member 54 is a knob that rotates about the axis 57. It is contemplated that the actuation member 54 could also comprise any of a wide variety of easily-actuated mechanical structures, such as a lever.

Figure 3:
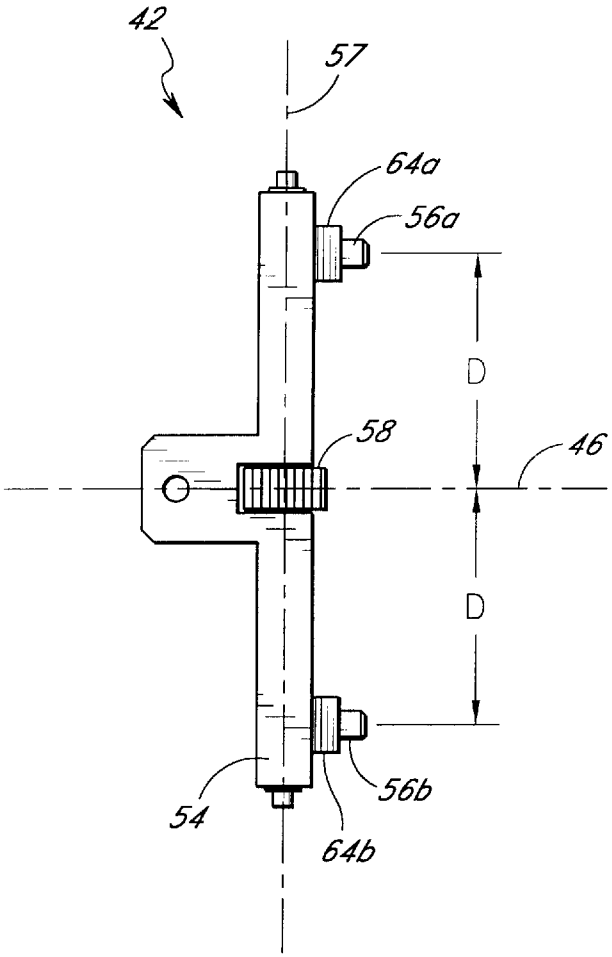
FIG. 3 is a side view of the torque tool of FIG. 2 taken along the line 3—3.
Figure 2:
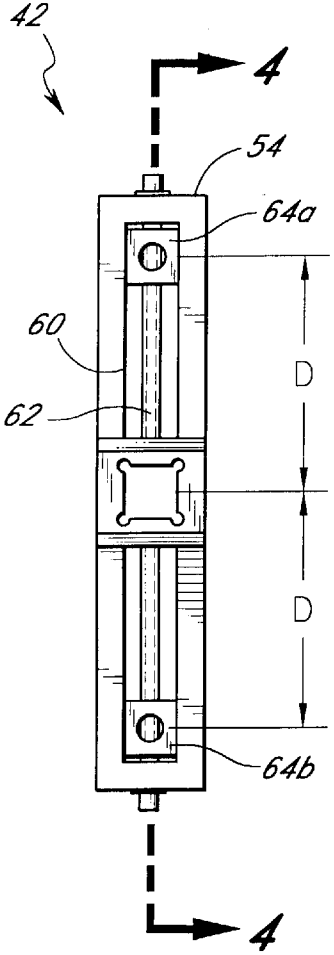
FIG. 2 is a front view of the torque tool of FIG. 1.

FIGS. 2 and 3 illustrate front and side views, respectively, of the adapter portion 42 of the torque tool 20. As best shown in FIG. 2, an elongated aperture 60 extends into the front of the head section 54. A threaded rod 62 extends within the head section 54 along the axis 57 so as to be visible through the elongated aperture 60. A central section of the threaded rod 62 is fixedly engaged with the actuation member 58 so that rotation of the actuation member 58 causes rotation of the threaded rod 62. The actuation member 58 divides the threaded rod 62 into a right-hand threaded section and a left-hand threaded section. That is, the portion of the threaded rod 62 to one side of the actuation member 58 has right-handed threads and the portion to the other side of the actuation member 58 has left-hand threads, the function of which will become apparent from the disclosure herein.

As shown in FIGS. 2 and 3, mounting blocks 64*a* and 64*b* are mounted on the threaded rod 62 on either side of the actuation member 58, as described in detail below. As best shown in FIG. 3, the mounting blocks 64*a* and 64*b* are sized such that a portion of each of the mounting blocks 64*a* and 64*b* extends outward through the elongated aperture 60. The pins 56*a*, 56*b* extend from these portions of the mounting blocks 64*a*, 64*b*. Referring to FIG. 2, the width of the mounting blocks 64*a*, 64*b* are slightly smaller than the width of the elongated aperture 60 so that the mounting blocks 64*a*, 64*b* are slidable along the length of the elongated aperture 60.

Figure 4:
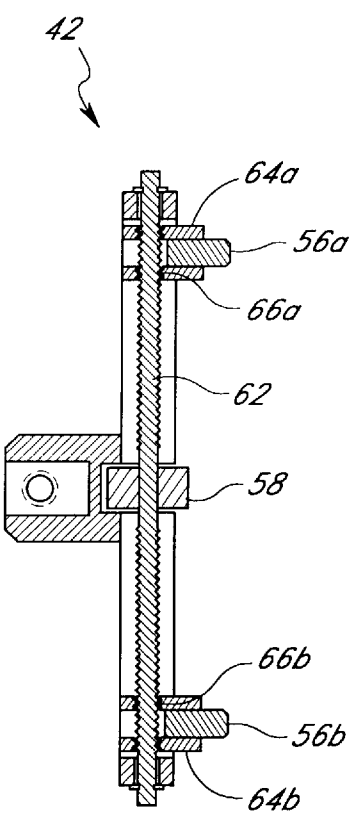
FIG. 4 is a cross-sectional view of the torque tool of FIG. 2 taken along the line 4—4.

FIG. 4 is a cross-sectional view of the adapter portion 42 taken along line 4—4 of FIG. 2. As shown, the threaded rod 62 extends through internal threaded apertures 66*a*, 66*b* in each of the mounting blocks 64*a* and 64*b*, respectively. The threads of the threaded apertures 66*a* and 66*b* are in meshed engagement with the threads of the threaded rod 62. When the threaded rod 62 is rotated via the actuation member 58, the threaded engagement between the threaded rod 62 and the internal threaded apertures 66*a* and 66*b* causes the mounting blocks 64*a*, 64*b* to move along the length of the threaded rod 62. Because the mounting blocks 64*a*, 64*b* extend through the elongated aperture 60, the mounting blocks 64*a*, 64*b* do not rotate with the threaded rod 62 but are rather guided along the length of the elongated aperture 60.

As discussed, the threaded rod 62 is divided into a right-hand threaded section and a left-hand threaded section on either side of the actuation member 58. Thus, as the threaded rod 62 rotates (through rotation of the actuation member 58), the mounting blocks 64*a* and 64*b* travel in opposite directions along the length of the threaded rod 62. For example, the actuation member 58 may be rotated in one rotational direction to move the mounting blocks 64*a* and 64*b* toward each other and thereby reduce the distance D. When the actuation member 58 is rotated in the opposite direction, the mounting blocks 64*a* and 64*b* move away from each other to increase the distance D. The particular relationship between the direction of rotational movement of the actuation member 58 and the direction of linear movement of the blocks 64*a*, 64*b* is determined by which side of the actuation member the left hand and right hand threaded sections are located. This may be varied without departing from the scope of the invention.

Referring to FIG. 4, in one embodiment, the pins 56*a*, 56*b* are removably coupled to the mounting blocks 64*a*, 64*b*. In particular, each pin 56 has a dowel section that mates in a press-fit fashion with a recess of corresponding size and shape that extends into each of the mounting blocks 64*a*, 64*b*. Because the pins 56*a*, 56*b* are removably coupled to the mounting blocks 64*a*, 64*b*, a user may install pins of various sizes or shapes that are particularly suited to engage particular fan assemblies.

FIG. 1 illustrates one manner in which the torque tool 20 is used to apply torque to a fan assembly 22 and thereby tighten the fan assembly 20 onto the mounting structure 23. First, the threaded section 36 is at least partially engaged with the threaded aperture 38 in the mounting structure 23. The pins 56*a* and 56*b* are then engaged with the mounting notches 34*a* and 34*b*, respectively, on the fan housing 26. The size of the pins 56*a*, 56*b* is selected so that the pins 56*a*, 56*b* fit snugly into the mounting notches 34. Because the pins 56*a*, 56*b* are removably coupled to the mounting blocks 64*a*, 64*b*, pins having a size and shape suited for the particular mounting notches 34 may advantageously be selected and coupled to the torque tool 20. When the pins 56*a*, 56*b* are engaged with the mounting notches 34, a user applies torque to the fan assembly 22 by rotating the torque driver 44. The engagement between the pins 56*a*, 56*b* and the mounting notches 34 transfers the torque from the torque driver 44 to the fan assembly 22. This causes the fan assembly 22 to rotate so that the threaded portion 36 tightens onto the mounting structure 23.

The torque tool 20 may advantageously be used to apply torque to CPU fan assemblies of various sizes by adjusting the distance between the pins 56*a*, 56*b* using the actuation member 58. The user rotates the actuation member 58 to move the pins 56*a*, 56*b* along the axis 57 until the distance between the pins 56*a*, 56*b* corresponds to the distance between the mounting notches 34. Toward this end, in one embodiment the actuation member 58 is positioned where the user's thumb is located when the user holds the torque tool 20. In this manner, the user may position the torque tool 20 adjacent the fan assembly 20 and rotate the actuation member 58 with the thumb until the pins 56*a*, 56*b* engage the mounting notches 34. It will be appreciated that the size of the threads on the threaded rod 62 may be varied to provide various distances of travel of the pins 56*a*, 56*b* as the actuation member 58 is rotated.

The pins 56*a*, 56*b* can also be engaged with various other locations on the fan assembly 22 if the particular fan assembly 22 does not have mounting notches provided thereon. For instance, the position of the pins 56*a*, 56*b* can be adjusted to butt against the outside surface of the fan housing 26. For such coupling, the user engages the torque tool 20 to the fan assembly 22 by moving the pins 56*a*, 56*b* closer to each other until the pins 56*a* and 56*b* squeeze and hold the housing 26 therebetween. Alternatively, the position of the pins 56*a*, 56*b* can be adjusted so that the pins press against the inner surface of the fan housing 26. The position of the pins 56*a*, 56*b* can also be adjusted to engage a portion of the fan 30. Once the pins 56*a*, 56*b* are engaged with the fan assembly 22, the user may apply torque in the manner described above.

In the illustrated embodiment, the pins 56*a*, 56*b* have a cylindrical shape. Such a shape is desirable because it will fit into mounting notches 34 of various shapes. In one embodiment, the pins have a diameter of approximately ⅛ inch. It will be appreciated that the shape and texture of the pins 56*a*, 56*b* can also be configured to increase the likelihood of the pins 56*a*, 56*b* securely engaging the outer or inner surface of the fan assembly 22 if no mounting notches 34 are present. For instance, the pins 56 can have jagged or curved outer surfaces to facilitate a secure engagement between the pins 56*a*, 56*b* and the surface of the housing 26. As discussed above, the pins 56*a*, 56*b* are removable so that a user may install pins 56*a*, 56*b* particularly suited for the job at hand.

The torque tool 20 is thus a tool specially designed to tighten CPU fan units onto a mounting structure in a computer. The torque tool 20 is advantageously adjustable so that it may be used with fan units of various sizes and styles. The tool 20 is configured to be removably mounted to current torque driving tools, such as a socket screw driver or ratchet wrench. The torque tool 20 is capable of applying uniform and predetermined levels of torque to a fan unit in order to reduce the risk of over-tightening and breakage to the fan unit or mounting structure.

Although the foregoing description of the invention has shown, described and pointed out the fundamental novel features of the invention, it will be understood that various omissions, substitutions, and changes, in the form of the detail of the apparatus as illustrated, as well as the uses thereof, may be made by those skilled in the art without departing from the spirit of the present invention. Consequently, the scope of the invention should not be limited to the foregoing discussion, but should be defined by the appended claims.

What is claimed is:

1. An assembly comprising:

a CPU fan unit comprising a housing with a pair of notches formed therein;

a torque tool configured to apply torque to said CPU fan unit, said torque tool comprising:

a main section extending along a longitudinal axis;

a head section connected to said main section, said head section defining a transverse axis oriented at an angle relative to said longitudinal axis;

a pair of mounting pins extending from said head section, said mounting pins movably positioned along said transverse axis and inserted into said pair of mounting notches in the fan unit so as to apply torque thereto;

an actuation member coupled to said mounting pins, said actuation member configured to adjust the position of said mounting pins along said transverse axis.

2. The assembly of claim 1, wherein said head section includes a threaded rod coupled to said actuation member and said mounting pins, said threaded rod having a right-hand threaded section and a left-hand threaded section, wherein one of said pair of mounting pins is coupled to the right-hand threaded section and the other of said pair of mounting pins is coupled to the left-hand threaded section.

3. The assembly of claim 2, additionally comprising first and second mounting blocks positioned on said threaded rod on either side of said actuation member, wherein one of said mounting pins is removably attached to a first mounting block and another of said mounting pins is attached to a second mounting block.

4. The assembly of claim 1, wherein said pair of mounting pins are ⅛ inch in diameter.

5. The assembly of claim 2, wherein said actuation member is a rotatable knob mounted to said threaded rod.

6. The assembly of claim 5, wherein said knob is mounted on said threaded rod between said right-hand threaded section and said left-hand threaded section.

7. The assembly of claim 1, wherein said main section is removably connected to said head section.

8. The assembly of claim 7, wherein said main section comprises a torque driver.

9. The assembly of claim 8, wherein said main section couples to said head section through a socket connection.

10. The assembly of claim 9, wherein said torque driver is a ratchet wrench.

* * * * *